United States Patent [19]

Beyler

[11] 4,061,113

[45] Dec. 6, 1977

[54] PROCESS FOR REDUCING THE POLLUTION DUE TO AN INTERNAL COMBUSTION ENGINE, AND AN ENGINE INCLUDING THE APPLICATION OF SAID PROCESS

[76] Inventor: Roland Beyler, 61, Avenue du Marechal Joffre, 94360 Bry-sur-Marne, France

[21] Appl. No.: 630,175

[22] Filed: Nov. 10, 1975

Related U.S. Application Data

[63] Continuation of Ser. No. 437,739, Jan. 29, 1974, abandoned.

[51] Int. Cl.[2] ..... F02B 41/00; F02P 1/00; F02B 33/00

[52] U.S. Cl. ..... 123/26; 123/169 V; 123/119 D; 123/32 SJ; 123/148 DS; 123/148 C

[58] Field of Search ..... 123/169 V, 119 D, 124 R, 123/26, 32 SJ, 143 B, 148 DS, 148 C

[56] References Cited

U.S. PATENT DOCUMENTS

| | | | |
|---|---|---|---|
| 1,754,796 | 4/1930 | McElroy | 123/169 V |
| 1,937,801 | 12/1933 | Tibbetts | 123/26 |
| 2,534,346 | 12/1950 | Fenney | 123/26 |
| 2,756,268 | 7/1956 | Knudson | 123/148 DS |
| 3,204,139 | 8/1965 | Candelise | 123/169 V |
| 3,534,714 | 10/1970 | Urlaub | 123/143 B |
| 3,558,251 | 1/1971 | Bauger et al. | 431/266 |
| 3,794,008 | 2/1974 | Mathews | 123/148 DS |

*Primary Examiner*—Ronald B. Cox
*Attorney, Agent, or Firm*—Eric P. Schellin

[57] ABSTRACT

The process comprises producing in a combustion chamber of the engine a high-tension electrical discharge, prolonging the duration of the discharge, and supplying additional air in the vicinity of the discharge so as to form a plasma and cause a post-combustion in the cylinder.

An internal combustion engine is disclosed which carries out this process. The engine comprises for each cylinder a high-tension ignition spark plug and an air supply conduit in the vicinity of the high-tension electrode of the spark plug. Valve means open the conduit at least during the driving stroke of the piston. An electric supply circuit for the spark plug comprises an ignition distributor having a rotary contact of such dimension that it maintains the supply of current to the spark plug during at least a part of the expansion stroke of the piston.

22 Claims, 5 Drawing Figures

PROCESS FOR REDUCING THE POLLUTION DUE TO AN INTERNAL COMBUSTION ENGINE, AND AN ENGINE INCLUDING THE APPLICATION OF SAID PROCESS

This is a continuation of application Ser. No. 437,739, filed Jan. 29, 1974, now abandoned.

It is well known that one of the reasons for the pollution of the atmosphere by internal combustion engines and in particular automobile engines, is the presence of carbon monoxide and hydrocarbon in the exhaust gases of the engines. Now, the presence of these polluting residues is essentially the consequence of an incomplete combustion of the fuel employed.

An object of the present invention is to overcome this drawback by means of a post-combustion which increases the oxidation of the gases and completes the combustion of the hydrocarbons.

The invention provides a process which comprises producing in the combustion chamber of the engine a high-tension spark, prolonging the duration of said spark and supplying additional air in the vicinity of said spark so as to form a plasma and cause a post-combustion in the cylinder of said engine.

The prolonging of this spark and the creation of the plasma permits a re-ignition of the gases during the expansion stroke of the piston and the obtainment of a substantially complete combustion which considerably diminishes the amount of unburnt hydrocarbons. Moreover, the presence of additional air improves the oxidation of the fuel mixture and increases the pourcentage of oxygen in the residual gases. At the same time, this fresh air lowers the temperature of the gases and therefore the temperature of the spark plug and head of the piston and avoids any deterioration of the spark plug and head by the effect of heat.

This supply of additional air may be prolonged during the entire expansion stroke of the piston and possibly even during almost the whole of the exhaust which ensures an effective discharge of the residual gases and a less polluted air in the cylinder.

According to the embodiments of the invention, the spark may be prolonged and the inlet of additional air opened during the entire expansion of the gases and possibly even during almost the whole of their discharge, or the spark may be simply prolonged during the first part of the expansion whereas the additional air is introduced during the whole of said expansion and even maintained thereafter.

The present invention also concerns an internal combustion engine which carries out this process and which comprises a high-tension ignition spark plug, an air supply in the vicinity of the high-tension electrode of the spark plug, means for controlling the opening of said air supply, and an electric supply circuit for the spark plug comprising an ignition distributor provided with a rotary contact for maintaining the supply of the spark plug during at least a part of the expansion stroke of the piston.

The distributor is preferably provided with contact means in the form of a sector of a circle connected to a hightension source, but it may also be supplied from the voltage sector supplying the ignition box. This sector of a circle has for example, in particular in the case of an engine having four cylinders with a two-stage distributor, an arc of 90° so that it remains in contact with the surface of the spark plug to be supplied during ¼ of a revolution. It will be understood that this sector may be smaller or larger depending on the duration of the spark to be obtained.

The supply of additional air may possibly be employed for supplying air to the fuel mixture. In this case, the means controlling the air supply are connected to the fuel supply so as to regulate the mixture during the period of intake of the latter into the cylinder.

In another embodiment, the fuel may be also introduced into the cylinder through the ignition spark plug.

The following description of one embodiment given by way of a non-limitative example and shown in the accompanying drawing will show the advantages and features of the invention.

Figure 1:
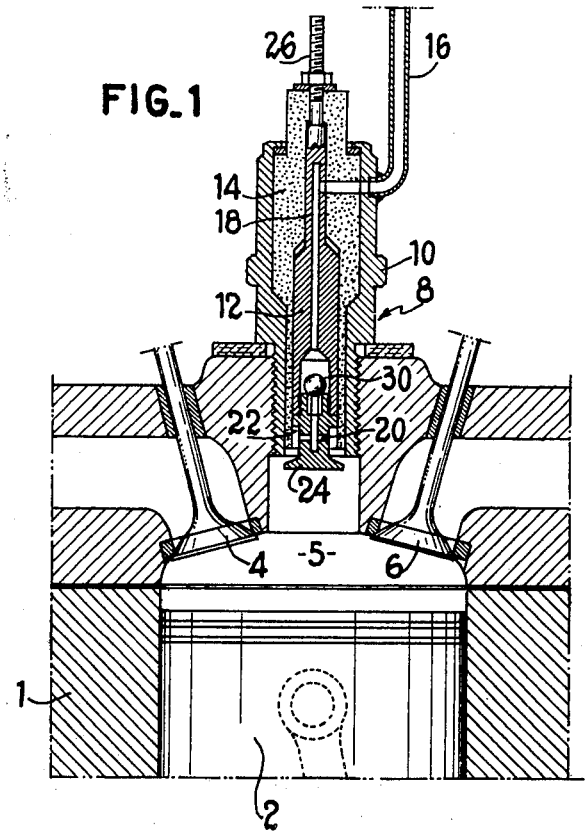
FIG. 1 is a sectional view of the upper part of the cylinder of an engine having a reciprocating piston.

The internal combustion engine shown in FIG. 1 comprises in the conventional manner a cylinder 1 in which a piston 2 is slidable. In the upper part of the cylinder there are disposed the two valves 4 and 6 which are respectively for the intake and exhaust of the fuel mixture. Moreover, in the vicinity of these valves, at the top end of the combustion chamber 5, there is provided an ignition spark plug 8 for producing a high-tension electrical fuel-igniting discharge.

The spark plug 8 according to the invention is a high-tension spark plug whose earth electrode is constituted by a cylindrical outer body 10 screwed in the upper part of the wall of the combustion chamber 5. The high-tension electrode 12 is mounted axially in the body 10 and separated from the latter by a ceramic insulating sleeve 14. A conduit 16 connected to an air supply circuit (not shown) is secured to the body 10 and communicates with a bent conduit 18 which extends axially through the high-tension electrode 12. The conduit 18 opens by way of radial or tangential passages 20 into an annular passage 22 formed between the high-tension electrode 12 and the insulating sleeve 14 and communicating with the interior of the combustion chamber 5. The air supplied by way of the conduit 16 may also be introduced directly between the sleeve 14 and the spark plug body 10 and possibly caused to rotate by fins or inclined orifices. Preferably, as shown in FIG. 1, the electrode 12 terminates inside the combustion chamber in a deflector 24 which constrains the air arriving by way of the annular passage 22 to spread or fan out and imparts thereto a whirling motion.

The high-tension electrode 12 is moreover connected through a conductor 26 to an electric supply device of conventional type comprising one or more ignition boxes delivering a voltage of the order of 10 kvolts and supplied by an alternator. This voltage is transmitted to the spark plug 8 through a distributor comprising a rotary contact which has a relatively large surface area and thus maintains the supply to the spark plug during a period distinctly greater than the conventional duration of the spark. This contact is, for example, constituted by a sector of a circle which remains in contact with the supply circuit of the spark plug 8 while it rotates through an angle corresponding to its axis.

Consequently, when the piston 2 reaches the vicinity of the upper part of the cylinder 1 at the end of the air/fuel mixture compression stage a high-tension spark or discharge is produced between the electrode 10 and 12 of the spark plug and causes the explosion and combustion of the mixture. This discharge is prolonged owing to the particular form of the distributor, whereas the piston 2 starts its expansion stroke. The fuel mixture therefore continues to burn. Moreover, additional air is introduced by way of the conduits 16 and 18 and the passages 20 and 22 and converted into a plasma by the high-tension discharge of the spark plug. This plasma is propagated in the direction of the residual fuel mixture contained in the cylinder and prolongs the combustion of this mixture. This combustion then occurs in a chamber of variable volume constituted both by the combustion chamber 5 and a part of the cylinder 1.

According to the shape of the sector of contact of the distributor, the spark may be prolonged during the whole of the expansion stroke of the piston and possibly even during its exhaust stroke. The additional air is also introduced in these two stages of the engine cycle. Maximum combustion is thereby achieved.

Throughout this additional or post-combustion, the mixture is oxygenated so that the residual gases expelled by way of the exhaust pipe contain a pourcentage of oxygen which is much higher than the residual gases of conventional engines, the carbon monoxide and hydrocarbon content of these gases being moreover considerably lower.

The prolonging of the supply of additional air during the exhaust stage facilitates the exhaust of the residual gases. Moreover, this additional air cools, during the entire period of combustion, the spark plug and the head of the piston and this lowers the temperature of the whole of the engine and precludes any danger of harming the latter under the effect of an excessively high temperature such as that of the plasma or of the arc of the spark plug.

The supply to the conduit 16 of air from a compressor, a pump or any other source may be controlled by suitable means such as valves or the like connected to the drive. However, in some cases this supply of air may be controlled by means of a check valve such as that shown at 30 in FIG. 1. This valve, which is of the type having a ball valve member, is so set as to close when the pressure inside the combustion chamber 5 exceeds a given pressure. Thereafter, this valve is closed at the end of the compression stage, it remains closed during the ignition of the air-fuel mixture and during the explosion. However, in the course of the expansion, the drop in the pressure in the cylinder 1 causes this valve to open and allows the additional air to be supplied which facilitates the formation of the plasma and the post-combustion in the cylinder.

In such an embodiment, the valve 30 may, if desired, be opened during the intake stage so that the conduits 16 and 18 perform the function not only of an inlet for additional air but also of an inlet for normal air which is part of the air fuel mixture. The intake pipe controlled by the valve 4 is then merely connected to a fuel supply (injection pump) and the carburetor may be dispensed with and replaced by a system for regulating the pressure of the air entering by way of the conduit 16 in accordance with the supply of fuel. However, it may be preferable to maintain the carburetor but to regulate the latter in such manner that it supplies to the intake pipe a mixture which is poor in air and that the proportions of this mixture are completed by air arriving by way of 22 through the spark plug 8 during the intake stage.

In another embodiment, the spark plug 8 may also be provided with a fuel supply, for example by connecting the conduit 16 through a two-way valve either to the fuel supply carburetor or to a supply of air alone. This valve is then controlled in accordance with the position of the piston.

It will be understood that the shape of the spark plug 8 may be modified. For example, in order to achieve a more precise regulation of the spark, a spark plug such as that shown in FIG. 2 may be employed which has only a single high-tension electrode 32 placed axially in a ceramic sleeve 34 carried by a body 33. This electrode 32 terminates inside the combustion chamber 35 in a deflector 36. Formed between the sleeve 34 and the body 33 is an annular conduit 38 which is connected through a conduit 40 secured the body 33 to a source of air. Fins 42 are provided in the annular conduit 38 in the vicinity of the deflector 36 so as to impart a whirling motion to the air before it enters the combustion chamber 35. Further, the head of the piston 44 of the engine is electrically connected to earth and thus constitutes the second electrode of the spark plug. In such an engine, the ignition discharge is maintained so long as the piston 44 is sufficiently near to the high-tension electrode 32. This discharge occurs a little before the end of the compression stroke of the piston, as soon as the latter moves sufficiently near to the deflector 36, and is prolonged during the beginning of the descent of the piston. As in the foregoing embodiment, the supply of air by way of the conduit 40 forms a plasma around the deflector 36 and thus ensures the re-ignition of the fuel mixture inside the cylinder. This supply of air can be controlled by a check-valve mounted in the conduit 40 or any other suitable means.

Figure 3:
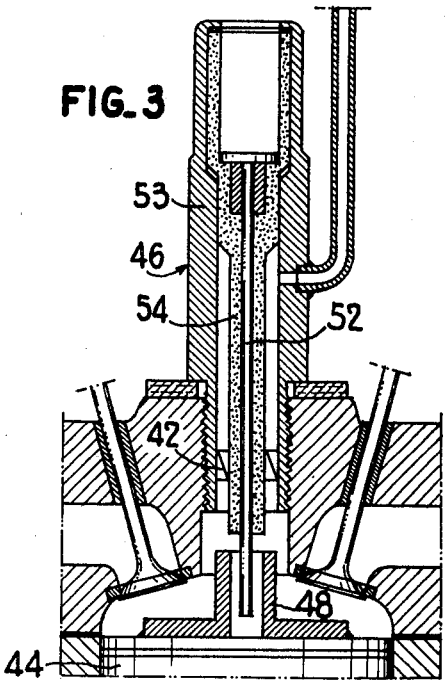

To increase the duration of the discharge, the head of the piston 44 (FIG. 3) which constitutes the earth electrode can be provided with a cylindrical spigot 48 into which the end of the high-tension electrode 52 of the spark plug 46 may extend. In this case, as shown in FIG. 3, the electrode 52 does not possess a deflector but is extended a certain distance beyond the ceramic sleeve 54 which insulates it from the outer body 53. The discharge is thus prolonged during the whole of the period in which the space between the electrode 52 and the spigot 48 is relatively small. The choice of the height of this spigot enables the discharge to be given the desired duration. The spigot is provided preferably with orifices for the flow of air issuing from the spark plug.

Figure 2:
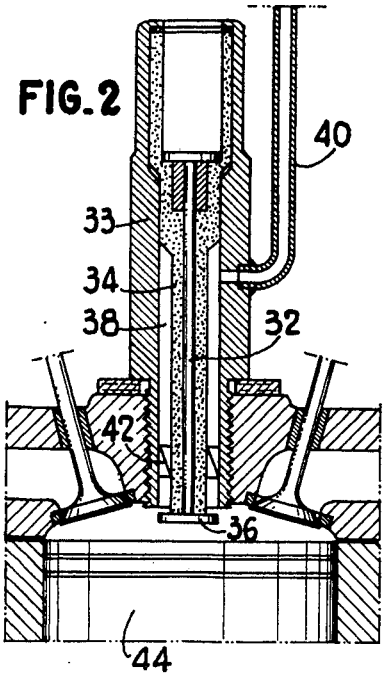
FIGS. 2 and 3 are also longitudinal sectional views of modifications of the ignition spark plug of the engine.

With an arrangement of this type, in the same way as with the arrangement shown in FIG. 2, the electrodes 32 or 52 may be supplied during a relatively long period of time. It is in fact the position of the piston which controls the duration of the discharge. The additional air supply may be, if desired, controlled by a check-valve of the type of the valve 30 employed in the spark plug 8. It may also be employed as a main air supply for the combustible mixture.

In some cases, the circuit supplying the spark plug may be such that the spark plug is constantly supplied and that the discharge is produced automatically when the piston approaches it. An ignition then occurs at the end of the discharge of the residual gases which produces a post-combustion in the exhaust pipe and reaches still more the carbon monoxide and hydrocarbon content in these gases.

It will be understood that various modifications may be made in the engine system described hereinbefore and, in particular, the additional air may be supplied from outside the spark plug at a point which is extremely close to the high-tension electrode of the latter. The air supply trough the spark plug is, however, the best for the cooling of the latter and the formation of the plasma. The air is always introduced in the vicinity of the high-tension electrode whether it be around the latter, between the two electrodes, or in the vicinity of the latter.

Figure 4:
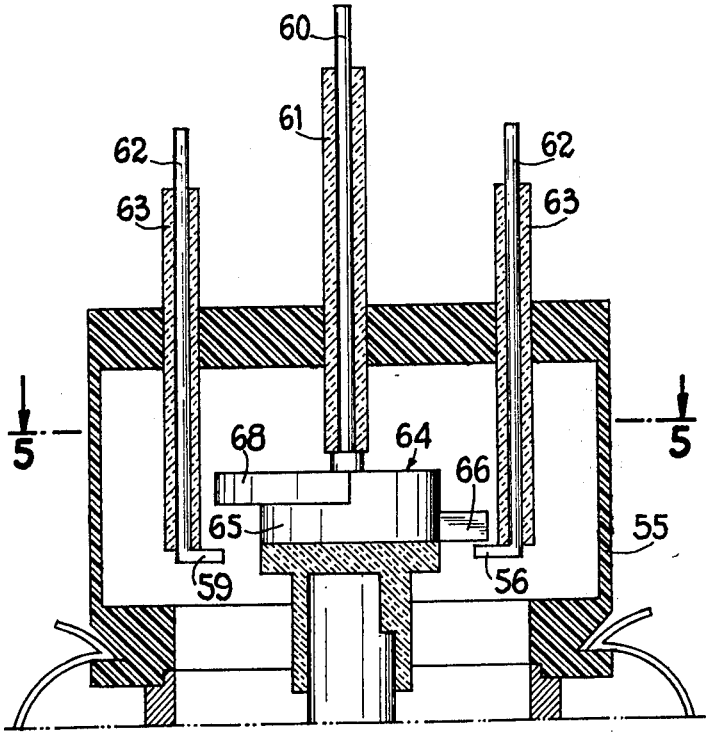
FIG. 4 is a diagrammatic longitudinal sectional view of the distributor of a four-stroke engine according to the invention.
Figure 5:
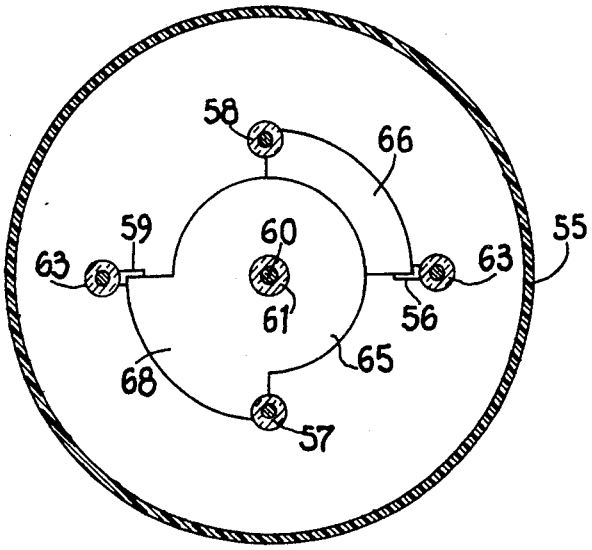
FIG. 5 is a sectional view taken on line 5—5 of FIG. 4.

The engine just described may be associated with other similar systems in the construction of an engine having a variable number of cylinders and the shape of the contact of the distributor is governed by this number so as to ensure a successive supply of current to the spark plug in the required order and for a sufficient duration. FIGS. 4 and 5 show an embodiment of a distributor for supplying an engine having four cylinders.

The distributor comprises, inside a cylindrical case 55, four terminals 56, 57, 58 and 59 each of which is connected to the spark plug 8 of a cylinder and a vertical member 60 connected to a source of high-tension (not shown).

The member 60 is secured to the centre of the case and is connected to the high-tension circuit through a conductor surrounded by an insulating sheath 61 for example of ceramic. However, it may also be supplied by the primary circuit of the supply box (supply voltage). Conductors 62, surrounded by an insulation 63, connect the spark plug 8 to the terminals 56, 57, 58, 59. The terminals 56 and 59, on one hand and 57 and 58 on the other hand, are disposed at two different levels. They are, however, separated by identical angular distances. In the centre of the case 55, between these terminals, there is rotatably mounted a contact means 64 which is coaxial with the member 60 and connected to the latter at its centre. The contact means 64 comprises a cylinder 65 which is extended by two diametrally opposed sectors 66 and 68 which are located at different levels, one in its upper part and the other in its lower part. Each sector 66, 68 forms in the embodiment shown in the FIG., a quarter of a circle. The distance between the sectors 66 and 68 corresponds to the difference between the levels of the terminals 57, 58 and 56, 59 so that the terminals 56 and 59 may come in contact with the lower sector 66 whereas the terminals 57 and 58 may come in contact with the upper sector 68.

As shown in FIG. 5, when the contact means 64 rotates, the sector 66 is in contact with the terminal 56 during a ¼ of a revolution and leaves this terminal at the moment when the sector 66 once again comes in contact with the terminal 58, then this sector 58 releases this terminal 58 after a ¼ of a revolution whereas the sector 66 supplies the spark plug connected to the terminal 59 during a ¼ of a revolution. It is finally the terminal 57 which is supplied and so on. Each spark plug is thus supplied with current during a ¼ of a revolution of the distributor, that is to say, during a ¼ of the cycle of the piston, which prolongs the electrical discharge during the entire expansion stroke of the piston. In fact, with this distributor, it is possible to obtain different spark discharge durations depending on whether this spark is produced between two electrodes of the discharge plug or between the high-tension electrode of the spark plug and the piston constituting the second electrode. In this first case, the duration of the ignition is multiplied by 8,000; in the second case, only by about 1,000.

It will be understood that it is possible to envisage giving the sectors 66 and 68 different dimensions to still further prolong the duration of the discharge or, on the other hand, to reduce this duration. Other shapes may also be given to the rotary means, depending on the number of spark plugs to be supplied with current and the duration of the desired ignition.

For example, the distributor may be provided with one, two or four stages or more, depending on the number of cylinders to be ignited and the duration of the discharge desired to be obtained (sector of 90° or more).

The distributor may be mechanical or electronic.

The regulation of the engine will be better adapted to these new conditions of operation.

Having now described my invention what I claim as new and desire to secure by Letters Patent is:

1. A process for reducing pollution due to an internal combustion engine piston and cylinder, which cylinder has two spark-producing electrodes in a combustion chamber of the cylinder, comprising starting a supply of high-tension electric current to said electrodes to initiate a high-tension electrical fuel-igniting discharge in the combustion chamber at the end of an air/fuel mixture compression stroke to cause explosion and primary combustion of said mixture, prolonging said supply of current to said electrodes in a continuous uninterrupted manner during at least a major part of the expansion stroke while at the same time supplying an annular-section stream of whirling additional air in the vicinity of and encompassing said initial electrical discharge so as to form a plasma which reaches the residual mixture contained in the cylinder and produces a secondary combustion which tends to complete the combustion in said cylinder.

2. An internal combustion engine comprising a cylinder and piston, air and fuel supply means for providing an air/fuel mixture, a high-tension ignition spark plug for the cylinder adjacent the top dead center end of the cylinder and having a high-tension electrode, additional air supply means in the vicinity of the high-tension electrode of the spark plug, said additional air supply means defining an annular passage coaxial with the electrode, means provided in said annular passage for imparting a whirling motion to said additional air flowing in the direction of the extremity of the electrode and into the cylinder, means for controlling the opening and closing of the additional air supply means and for opening the additional air supply means at least during a major part of the expansion stroke of the piston, an electric current supply circuit for the spark plug comprising means for prolonging the supply of current of the spark plug in a continuous manner to first initiate the electrical discharge for achieving a primary combustion of said mixture and thereafter without interruption achieve a secondary combustion during at least a major part of the expansion stroke of the piston.

3. An internal combustion engine comprising a cylinder and piston, air and fuel supply means for providing an air/fuel mixture, a high-tension ignition spark plug for the cylinder adjacent the top dead center end of the cylinder and having a high-tension electrode, additional air supply means in the vicinity of the high-tension electrode of the spark plug, said additional air supply means defining an annular passage coaxial with the electrode, means provided in said annular passage for imparting a whirling motion to said additional air flowing in the direction of the extremity of the electrode and into the cylinder, means for controlling the opening and closing of the additional air supply means and for opening the additional air supply means at least during a part of the expansion stroke of the piston, an electric current supply circuit for the spark plug comprising an ignition distributor having a rotary contact of such dimension that it prolongs the supply of current to the spark plug in a continuous manner to first initiate the electrical discharge for achieving a primary combustion of said mixture and thereafter without interruption achieve a secondary combustion during at least a part of the expansion stroke of the piston.

4. An engine as claimed in claim 3, wherein the distributor comprises at least one rotary contact in the form of a sector of a circle and a source of current connected to the rotary contact.

5. An engine as claimed in claim 3, wherein the spark plug has a second electrode and the air conduit opens out between the two electrodes.

6. An engine as claimed in claim 3, wherein the spark plug has a central electrode and the air conduit extends through the central electrode.

7. An engine as claimed in claim 3, comprising a fuel supply conduit extending through the spark plug and opening out in the vicinity of the high-tension electrode, and means for controlling the ratio between the air and fuel mounted between the conduit and the air supply means.

8. An engine as claimed in claim 3, wherein the air supply means are connected to a source of main air for the fuel mixture and to means to regulating said fuel mixture.

9. An engine as claimed in claim 3, wherein the spark plug comprises only a single electrode connected to a high-tension supply circuit, the piston being connected to earth and constituting a second electrode co-operative with said single electrode for creating an electrical discharge during the whole time during which said electrode and said piston are sufficiently near one another.

10. An engine as claimed in claim 9, wherein the head of the piston has a cylindrical spigot extending towards the spark plug which forms a tubular earth electrode and in which extends with clearance an end portion of the high-tension electrode of the spark plug, an annular gap being defined between said spigot and said high-tension electrode at the end of the compression stroke of the piston.

11. An engine as claimed in claim 3, wherein the supply means comprise a conduit extending through the ignition spark plug and opening out in the annular passage around the high-tension electrode.

12. An engine as claimed in claim 11, wherein the air supply conduit has inserted in the conduit a check valve which is responsive to the difference in pressures in the conduit and cylinder of the engine.

13. An engine as claimed in claim 11, wherein the high-tension electrode terminates inside the combustion chamber in a deflector and the air supply conduit inside the spark plug terminates in an annular part opening out in the region of the deflector.

14. An engine as claimed in claim 11, wherein said conduit opens out into the annular passage around the high-tension electrode by way of passages extending radially relative to said electrode.

15. An engine as claimed in claim 11, wherein said conduit opens out into the annular passage around the high-tension electrode by way of passages extending tangentially relative to said electrode.

16. An engine as claimed in claim 3, wherein the spark plug has a central electrode and the additional air supply conduit surrounds the central electrode and is terminated by an open annular passage around the extremity of said central electrode.

17. An engine as claimed in claim 3, comprising four cylinders and an ignition distributor having rotary contact means including a cylindrical block extended by a first contact sector and a second contact sector, said sectors being diametrally opposed and located at different levels, a first pair of diametrally opposed terminals disposed at a level corresponding to the level of the first sector and respectively connected to spark plug electrodes of two of said cylinders, a second pair of diametrally opposed terminals disposed at a level corresponding to the second sector and respectively connected to spark plug electrodes of the other two cylinders of said cylinders, the contact sectors being capable of engaging and disengaging from the corresponding terminals as the rotary contact means rotates, the size of the rotary contact sectors being such that each sector disengages from a terminal of one pair of terminals a short time before the other sector engages a terminal of the other pair of terminals and a centre member connected to the centre of the contact means for connection to a source of current.

18. A process for reducing pollution due to an internal combustion engine piston and cylinder, which cylinder has two spark-producing electrodes in a combustion chamber of the cylinder, comprising starting a supply of high-tension electric current to said electrodes to initiate a high-tension electrical fuel-igniting discharge in the combustion chamber at the end of an air/fuel mixture compression stroke to cause explosion and primary combustion of said mixture, prolonging said supply of current to said electrodes in a continuous uninterrupted manner during at least a part of the expansion stroke while at the same time supplying an annular-section stream of whirling additional air in the vicinity of and encompassing said initial electrical discharge so as to form a plasma which reaches the residual mixture contained in the cylinder and produces a secondary combustion which tends to complete the combustion in said cylinder.

19. A process as claimed in claim 18, wherein said supply of high tension current is prolonged continuously throughout the expansion stroke.

20. A process as claimed in claim 19, wherein said supply of high tension current is prolonged continuously also during at least a part of the exhaust stroke.

21. A process as claimed in claim 18, further comprising supplying additional air after the beginning of the ignition and during at least all of the expansion stroke.

22. A process as claimed in claim 18, wherein one of the electrodes is a high-tension electrode of a spark plug and the other electrode is the piston and said discharge is maintained all the time during which the gap between said high-tension electrode and piston is sufficiently small.

* * * * *